US009764564B2

(12) United States Patent
Grigore et al.

(10) Patent No.: US 9,764,564 B2
(45) Date of Patent: Sep. 19, 2017

(54) LOW TEMPERATURE ENERGY CURABLE PRINTING SYSTEMS AND METHODS

(71) Applicant: ELECTRONICS FOR IMAGING, INC., Fremont, CA (US)

(72) Inventors: Dan-Cristian Grigore, Nashua, NH (US); Paul Andrew Edwards, Kalamazoo, MI (US); Steven Billow, Bow, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 14/641,192

(22) Filed: Mar. 6, 2015

(65) Prior Publication Data

US 2016/0257135 A1 Sep. 8, 2016

(51) Int. Cl.
*B41J 11/00* (2006.01)

(52) U.S. Cl.
CPC ..... *B41J 11/002* (2013.01)

(58) Field of Classification Search
CPC ..... B41J 11/002; B05D 3/067
See application file for complete search history.

(56) References Cited

U.S. PATENT DOCUMENTS 6,550,905 B1 4/2003 Deckers et al.
7,211,299 B2 5/2007 Siegel et al.
7,232,212 B2 * 6/2007 Iwase ..... B41J 11/002 347/101
7,399,793 B2 * 7/2008 Braun ..... C05G 3/0029 427/402
7,638,780 B2 12/2009 Kilburn et al.
8,567,936 B2 10/2013 Edwards et al.
8,573,767 B2 11/2013 Edlitz et al.
2006/0290760 A1 * 12/2006 German ..... G03G 15/2007 347/102
2009/0207223 A1 * 8/2009 Cofler ..... B41J 3/28 347/102
2010/0230327 A1 * 9/2010 Hartrumpf ..... B07C 5/3425 209/577
2011/0117292 A1 * 5/2011 Wu ..... B05D 1/40 427/558
2013/0050367 A1 * 2/2013 Hoogmartens ..... C09D 11/101 347/100
2013/0083129 A1 4/2013 Thompson et al.
(Continued)

FOREIGN PATENT DOCUMENTS

JP 2003220699 A 8/2003
JP 2011011476 A 1/2011
(Continued)

*Primary Examiner* — Stephen Meier
*Assistant Examiner* — John P Zimmermann
(74) *Attorney, Agent, or Firm* — Perkins Coie LLP

(57) ABSTRACT

A system and methods for printing and curing ink deposited on a substrate using a first light source and a second light source. In various embodiments, the first light source emits one or more wavelengths of electromagnetic radiation subtype C (UVC), and the second light source emits one or more wavelengths of electromagnetic radiation subtype A (UVA), subtype B (UVB), subtype V (UVV), or a combination thereof. The substrate is configured such that any ink deposited on the substrate by a printer head is predominantly exposed to the first light source prior to the second light source.

18 Claims, 11 Drawing Sheets

(56) References Cited

U.S. PATENT DOCUMENTS

| | | | | |
|---|---|---|---|---|
| 2013/0194365 | A1* | 8/2013 | Edlitz | B41J 11/002 347/102 |
| 2013/0222499 | A1 | 8/2013 | Cong et al. | |

FOREIGN PATENT DOCUMENTS

| | | | |
|---|---|---|---|
| WO | 2010105365 | A1 | 9/2010 |
| WO | 2014041346 | A1 | 3/2014 |

* cited by examiner

LOW TEMPERATURE ENERGY CURABLE PRINTING SYSTEMS AND METHODS

TECHNICAL FIELD

This technology relates generally to an inkjet printing system and, in particular, to an inkjet printing system that can be used to improve curing for ultraviolet (UV) curable ink.

BACKGROUND

Inkjet printing and energy-curable inks have experienced significant development over the last decade. In general, these developments have focused on more effective and efficient means to cure the ink after it has been deposited onto a substrate.

The first energy-curable inkjet printing systems used medium pressure Mercury (vapor) bulbs. These bulbs were capable of producing a significant peak intensity ($W/cm^2$) and doses of UV radiation ($J/cm^2$) in a variety of wavelengths. UV radiation is categorized based on the emitted wavelength. Traditionally, there were three recognized categories: electromagnetic radiation subtype A (UVA) (400 to 315 nanometers), electromagnetic radiation subtype B (UVB) (315 to 280 nm), and electromagnetic radiation subtype C (UVC) (280 to 100 nm). Photoinitiators distributed throughout the ink are able to capture the UV photons emitted by the bulbs. The photoinitiators decomposed into free radicals when exposed to light, which promoted cross-linking at the surface and within the bulk of the ink.

Improvements were made to the medium pressure mercury bulbs by doping the bulbs with small amounts of iron, gallium, etc. These metals changed the distribution of the UV wavelengths emitted by the bulbs. For example, doping using iron caused the emission spectrum to shift higher, i.e. higher wavelength. Higher wavelengths can be beneficial for improving the depth at which curing takes place.

Although medium pressure mercury bulbs have been widely used, they are not without significant drawbacks. The bulbs tend to operate at a very high temperature (bulb surface can reach 650-900° C.), which then imparts heat to the substrate. These temperatures can cause substantial problems if the substrate is thin or heat-sensitive. Furthermore, the amount of UV emitted by the bulb is correlated with the heat of the bulb. Accordingly, if a given substrate requires that the bulb be turned down, i.e. lower intensity/temperature, then the bulb's ability to effectively cure is affected. This can result in poor adhesion, surface tackiness, etc. Various technologies have been used in an effort to reduce the temperature emitted by the bulbs, including dichroic reflectors and air and/or water cooling systems.

Advancements in UV light emitting diode (LED) lamp technologies have overcome some of the shortcomings associated with medium pressure mercury bulbs. Although widely-available LED lamps have a relatively limited wavelength range, e.g. 405 nm, 395 nm, 385 nm, 365 nm, the lamps exhibit a high peak intensity (16+$W/cm^2$). UV LED lamps are often used in conjunction with special ink formulations, which result in much lower heat output (and a wider range of potential substrates). UV LED lamps are also associated with lower power consumption and much longer lifetimes with more predictable power output.

However, at these wavelength ranges, i.e. 365 nm to 405 nm, limited curing occurs at the surface of the ink. In general, the curing is limited by oxygen radicals present at the ink's surface. Oxygen rapidly diffuses into the ink when a drop is ejected from the printer head and spreads out after impact with the surface of the substrate. The oxygen radicals found near the surface of the ink inhibit network formation and cross-linking.

Prior technologies have focused on how to reduce and/or eliminate oxygen present near the surface of the ink. One alternative is to use a nitrogen "blanket" that is created using compressed air and a filter that separates nitrogen and oxygen from the compressed air. Nitrogen concentrations of above 99% are possible. The filter pumps the filtered air over the surface of the ink, thereby reducing or eliminating the presence of oxygen. However, adding a suitable onboard filter and compressed air supply can prove difficult. For example, a smaller printer may not have access to compressed air, while a larger printer may require a large amount of Nitrogen, e.g. upwards of 200 L/min. These limitations may be prohibitive (cost, space, etc.) for many printer installations.

A second alternative is to modify the composition of the ink. More specifically, there are a number of chemical compositions that may be used to increase the surface cure of the ink, even in the presence of oxygen. The most effective chemical composition used today is N-vinyl caprolactam (V-Cap). Despite its effectiveness in promoting effective curing, the hazard classification for V-Cap has recently been modified, in particular for those ink formulations in which the V-Cap concentration exceeds 1% or 10%. Historically, V-Cap concentrations of more than 40% were used by some ink manufacturers. Thus, many ink manufacturers have begun searching for alternative means to facilitate surface curing.

SUMMARY

Introduced herein is an improved printing system that can be used to increase the surface and depth cure of ink formulations, including UV-curable inks, by exposing recently-deposited ink to two light sources ("the technology"). Various embodiments of the technology described herein include a printer head configured to deposit ink on a substrate; a first light source configured to emit one or more wavelengths of electromagnetic radiation subtype C (UVC); and a second light source configured to emit one or more wavelengths of electromagnetic radiation subtype A (UVA), subtype B (UVB), subtype V (UVV), or a combination thereof. The substrate is configured such that ink deposited by the printer head is exposed to the first light source prior to the second light source.

Also introduced herein is an improved method of printing that can be used to increase the surface and depth cure of inks. Various embodiments of the method described herein include depositing ink on a substrate using a printer head; and curing the ink by exposing the ink to a first light source and a second light source. The first light source is configured to emit one or more UVC wavelengths of electromagnetic radiation, while the second light source is configured to emit one or more UVA, UVB, and/or UVV wavelengths of electromagnetic radiation, or a combination thereof. The ink deposited by the printer head on the substrate is exposed to the first light source prior to the second light source.

Also introduced herein is a method of manufacturing a printing system, which can be used for more effective surface and depth curing of inks. Various embodiments of the method described herein include providing a printer head, and coupling the printer head to a first light source and a second light source. In various embodiments, the printer head can be configured to deposit UV-curable ink on a substrate. The first light source can be configured to emit one or more UVC wavelengths of electromagnetic radiation, while the second light source is configured to emit one or more UVA, UVB, and/or UVV wavelengths of electromagnetic radiation, or a combination thereof. In various embodiments, the first light source, second light source, and printer head are coupled such that the ink deposited by the printer head on the substrate is exposed to the first light source prior to the second light source.

DETAILED DESCRIPTION

Figure 1:
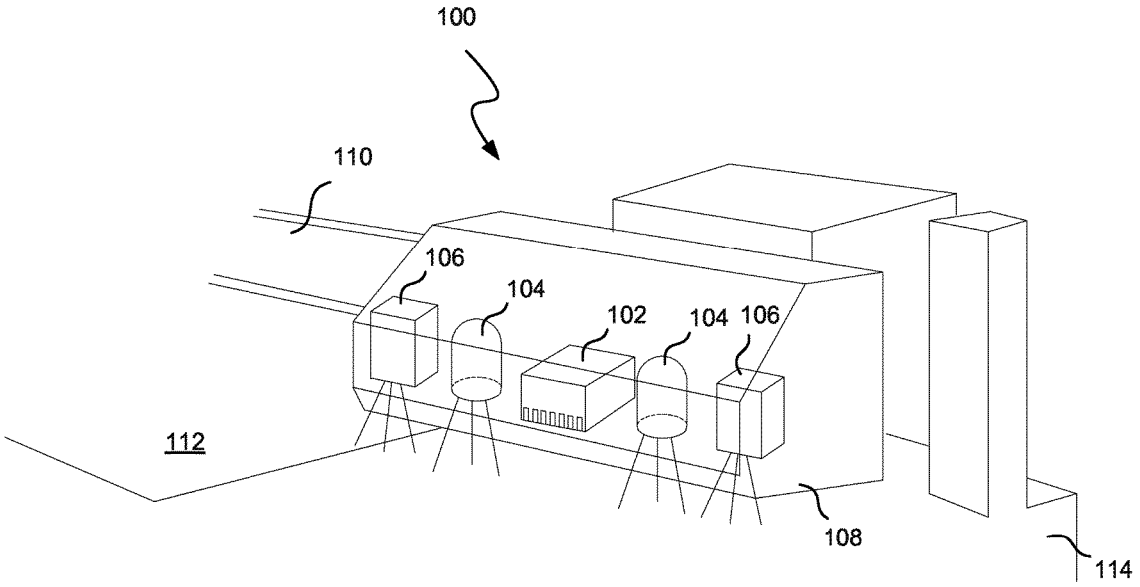
FIG. 1 is a perspective view of a printing system in accordance with various embodiments of the disclosure.

Referring now to FIG. 1, a perspective view of a printing system in accordance with various embodiments of the disclosure. The printing system 100 comprises a printer head 102, a first light source 104, a second light source 106, and a substrate 112. In various embodiments, the printer head 102 is an inkjet printer head configured to deposit ink on the substrate 112. The ink may be, for example, a solid, energy, e.g. UV, curable ink, a water-based energy curable ink, or a solvent-based energy curable ink. The first light source 104 of printer system 100 comprises one or more light sources configured to emit wavelengths of electromagnetic radiation subtype C (UVC). UVC wavelengths are, in general, those wavelengths measured between 100 nanometers (nm) and 280 nm. For example, in one embodiment a single first light source 104 can be positioned adjacent to the printer head 102. In an alternative embodiment, a plurality of first light sources 104 may be placed directly adjacent to the printer head 102, i.e. between the printer head 102 and a second light source 106, as shown in FIG. 1. "Directly adjacent," as that term is used herein, means neighboring without any intervening cure-functional items, e.g. UV light sources, in between. However, two components that are "directly adjacent" to one another may have empty space between them. The first light source may be, for example, a UVC fluorescent bulb, a UVC light emitting diode (LED), a low pressure, e.g. mercury, bulb, or an excited dimer (excimer) lamp and/or laser. In some embodiments, various combinations of UVC light sources may be used.

The second light source 106 of printer system 100 comprises one or more light sources configured to emit wavelengths of electromagnetic radiation subtype A (UVA), subtype B (UVB), subtype V (UVV), or some combination thereof. UVA wavelengths are those wavelengths measured between 315 nm and 395 nm. UVB wavelengths are those wavelengths measured between 280 nm and 315 nm. UVV wavelengths are those wavelengths measured between 395 nm and 445 nm. However, one skilled in the art will recognize that these ranges may be somewhat adaptable/malleable. For example, some embodiments may characterize wavelengths of 285 nm as UVC. In various embodiments, the second light source 106 can be positioned adjacent to the first light source 104, but opposite the printer head 102. Similarly, a plurality of second light sources may be placed adjacent to a plurality of first light sources 104, but opposite the printer head 102, as shown in FIG. 1. The second light source may be, for example, a UV LED configured to emit wavelengths of various lengths, e.g. 365 nm, 385 nm, 405 nm, 450 nm.

In various embodiments, the printer head 102, first light source 104, and second light source 106 may be coupled together, either directly or indirectly, within a carriage 108. The carriage 108 may house the aforementioned components, thereby protecting the components from damage. The carriage 108 may also serve other benefits, including limiting release of any heat generated by the first light source 104 and/or second light source 106. In various embodiments, the carriage 108 can be coupled to a rail 110, which allows the carriage 108 to pass over a substrate 112 designated for printing. The printing system 100 may comprise pulleys, motors, and/or any combination of mechanical and/or electrical technologies that enable the carriage 108 to travel along the rail 110. In alternative embodiments, the carriage 108 may be fixedly attached to the rail 110 or a base 114. In these embodiments, the substrate 112 can be moved in relation to the carriage 108, such that the printer head 102 is able to deposit ink on the substrate.

The substrate 112 may be, for example, glass, plastic, a paper composite, or any combination thereof. As described above, ink formulations are generally dependent on a number of factors, including, but not limited to, the curing process utilized, the substrate, and the application(s) for which the substrate is to be used. Traditionally, UV LED ink formulations have not used surface cure photoinitiators, chemical compounds that decompose into free radicals when exposed to light, because photoinitiators were not effective at higher wavelengths, e.g. UVA. In various embodiments of the present technology, photoinitiators can be used to maximize surface cure and depth cure. For example, a sample UVC/UVA LED ink formulation can be seen in Table 1. In the embodiment described in Table 1, the relative amount of photoinitiator in the energy curable ink is 11%. In general, the relative amount of photoinitiator in an ink formulation may range from 5% to 14%. In certain embodiments, e.g. very low UVC source wavelength (high energy), photoinitiators may not be present in the ink formulation at all. Alternative ink formulations may be utilized that promote sufficient surface cure without disrupting depth cure, thereby preventing defects, e.g. "Orange Peel". In some embodiments, the ink contains more than one photoinitiator chosen to absorb different wavelengths emitted by one or more light sources. More specifically, some ink formulations may incorporate more than one photoinitiator that each respond differently to different wavelengths of light. For example, the ink may include one photoinitiator adapted to absorb UVC wavelengths and another photoinitiator adapted to absorb UVB wavelengths.

TABLE 1

Sample UVC/UVA LED Ink Formulation

| Component | Concentration (By Weight) |
|---|---|
| Monomer | 72 |
| Oligomer | 10 |
| Surfactant | 1 |
| Inhibitor | 1 |
| Photoinitiator (Depth) | 9 |
| Photoinitiator (Surface) | 2 |
| Pigment Dispersion | 5 |
| Total | 100 |

Figure 2A:
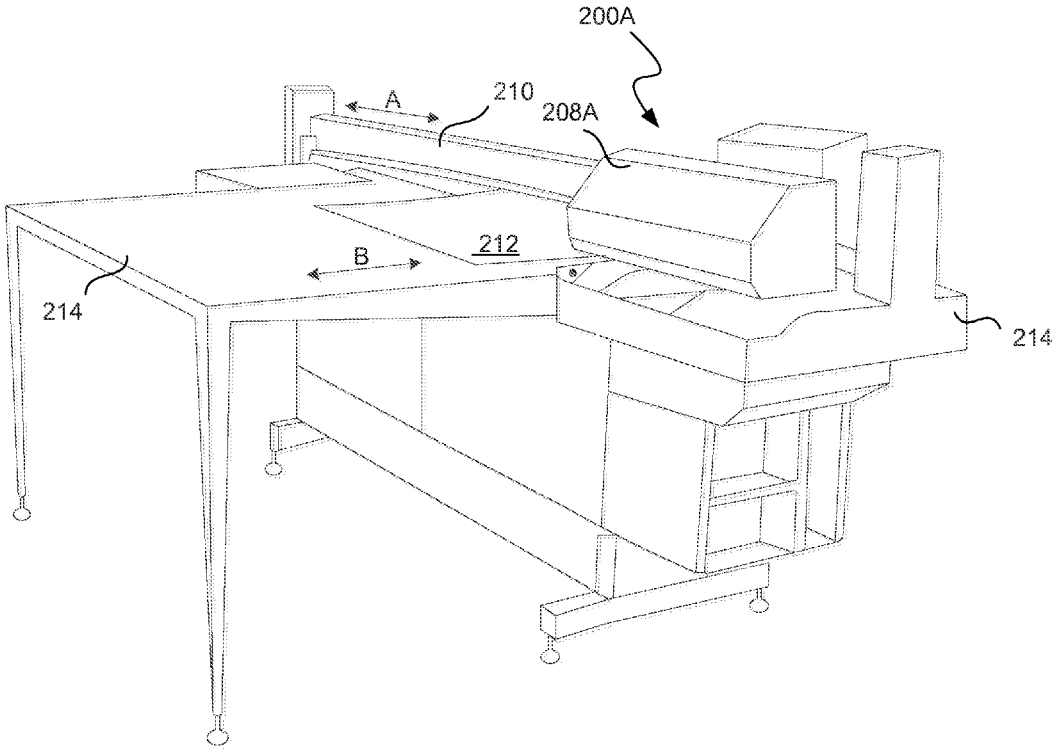
FIGS. 2A and 2B are expanded perspective views of a printer system, consistent with various embodiments.

FIG. 2A is an expanded perspective view of a printer system, consistent with various embodiments. The printing system 200A comprises a carriage 208A, a rail 210, a substrate 212, and a base 214. In various embodiments, the carriage 208A, such as the carriage 108 of FIG. 1, can house a printer head, e.g. printer head 102 of FIG. 1, a first light source, e.g. first light source 104 of FIG. 1, and a second light source, e.g. second light source 106 of FIG. 1. The carriage 208A can be coupled to the rail 210, which allows the carriage 208A to pass over the substrate 212 and deposit ink. In various embodiments, the printing system 200A may further comprise one or more mechanical and/or electrical technologies that enable the carriage 208A to travel along path A as designated in FIG. 2A. As the printer head deposits ink, the substrate 212 may be moved along path B as designated in FIG. 2A. In such embodiments, the printer head, first light source, and second light source can be arranged as shown in FIG. 1. That is, the one or more first light sources are positioned adjacent to the printer head, and the one or more second light sources are positioned adjacent to the first light sources and opposite the printer head. Any ink deposited by the printer head can be exposed to the one or more first light sources prior to the one or more second light sources. The base 214 can be used to support the carriage 208A, the rail 210, and/or the substrate 212 as it moves along path B.

Figure 2B:
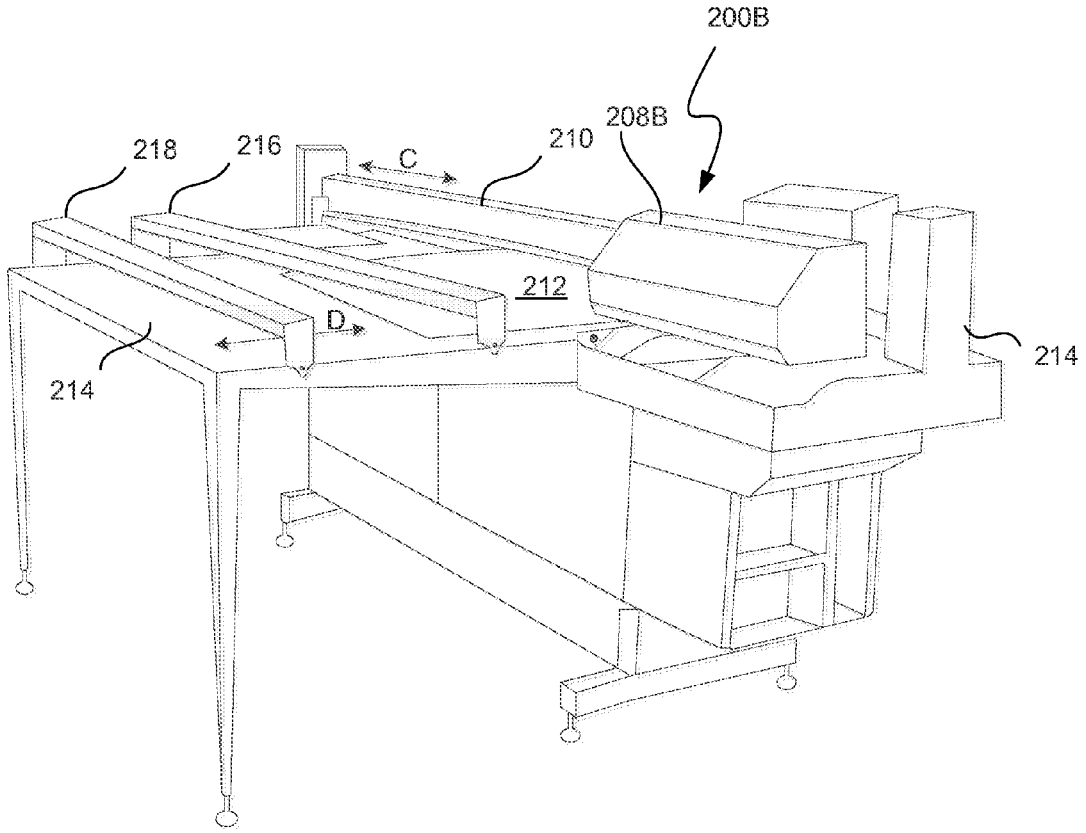

FIG. 2B is an expanded perspective view of a printer system, consistent with various embodiments. The printing system 200B comprises a carriage 208B, a rail 210, a substrate 212, a base 214, a first bank of one or more light sources 216, and a second bank of one or more light sources 218. In some embodiments, the carriage 208B may house a printer head, e.g. printer head 102 of FIG. 1. The carriage 208B can be coupled to the rail 210, which allows the carriage 208B to pass over the substrate 212 and deposit ink. In various embodiments, the printing system 200B may further comprise one or more mechanical and/or electrical technologies that enable the carriage 208B to travel along path C as designated in FIG. 2B. As the printer head deposits ink, the substrate 212 may be moved along path D as designated in FIG. 2B.

In some embodiments, a first bank of one or more light sources 216 may be fixedly attached to the base 214. The first bank of one or more light sources 216 can be positioned adjacent and parallel or substantially parallel to the carriage 208B and the rail 210, and can be configured to emit UVC wavelengths of electromagnetic radiation. In some embodiments, the first bank of one or more lights 216 may be housed in a carriage that runs along a rail parallel to carriage 208B and rail 210. In some embodiments, a second bank of one or more light sources 218 may be fixedly attached to the base 214. The second bank of one or more light sources 218 can be positioned adjacent and parallel to the first bank of one or more lights 216. The second bank of one or more light sources 218 can be configured to emit UVA, UVB, and/or UVV wavelengths of electromagnetic radiation. In some embodiments, the second bank of one or more light sources 216 may be housed in a carriage that runs along a rail parallel to carriage 208B and rail 210. The first bank of one or more light sources 216 and the second bank of one or more light sources 218 are configured such that any ink deposited by the printer head on the substrate 212 is predominantly exposed to the first bank of one or more light sources 216 prior to the second bank of one or more light source sources.

Figure 3A:
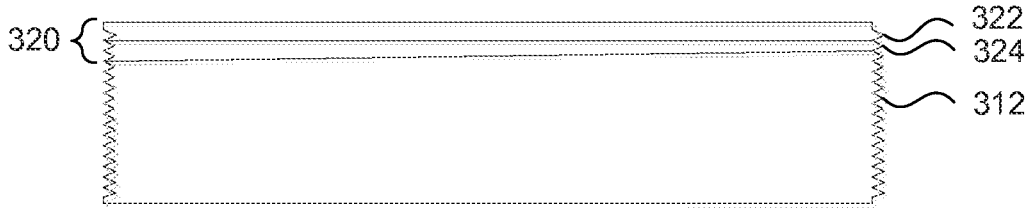
FIG. 3A is a side view of ink deposited on a substrate according to various embodiments of the disclosure.

Referring to FIG. 3A, a side view of ink deposited on a substrate according to various embodiments of the disclosure. The substrate 312, such as the substrate 112 of FIG. 1, is coated by a layer of ink 320, which comprises an upper level of ink 322 and a lower level of ink 324. In various embodiments, the ink can be energy, e.g. UV, curable ink. A layer of solid-based ink 320 may, for example, be 5 to 15 microns thick. As described above, an efficient and effective curing process requires that both the upper level of ink 322 and lower level of ink 324 be cured. In some embodiments, alternative ink formulations may be used that lower the concentration of solid material in the ink. In various embodiments, the concentration is measured by weight. The concentration of solids may be as low as 5% to 30%, and the remainder may consist of an organic solvent and/or water. In such embodiments, the thickness of the layer of ink 320 may be lowered and, in some cases, the ink may spread further on the substrate in comparison to an ink consisting of 100% solids. For example, if the concentration of solids is reduced to 10%, then the thickness of the layer of ink 320 may be reduced to 1.5 microns. Such a reduction may effectively eliminate the presence of a lower level of ink, e.g. lower level of ink 324 of FIG. 3A. In some embodiments, only a first light source configured to emit one or more wavelengths of UVC may be necessary. If the frequency of the UVC wavelengths is sufficiently low, e.g. 200 nm, then photon energy is raised and photoinitiators may not be necessary in order to cure the ink using the first light source described above.

In some embodiments, the use of water- or organic solvent-based inks may eliminate the need for photoinitiators. These embodiments, i.e. those with a significantly reduced thickness, may not require a second light source, e.g. second light source 106 of FIG. 1, that emits UVA, UVB, and/or UVV wavelengths of electromagnetic radiation. In some embodiments, the ink formulation may use oligomers and/or polymers rather than monomers of the reactive component. The larger molecular complexes present in oligomers and polymers are unable to migrate through most substrates. These improved ink formulations may be used in a variety of printing applications, including food packaging.

Figure 3B:
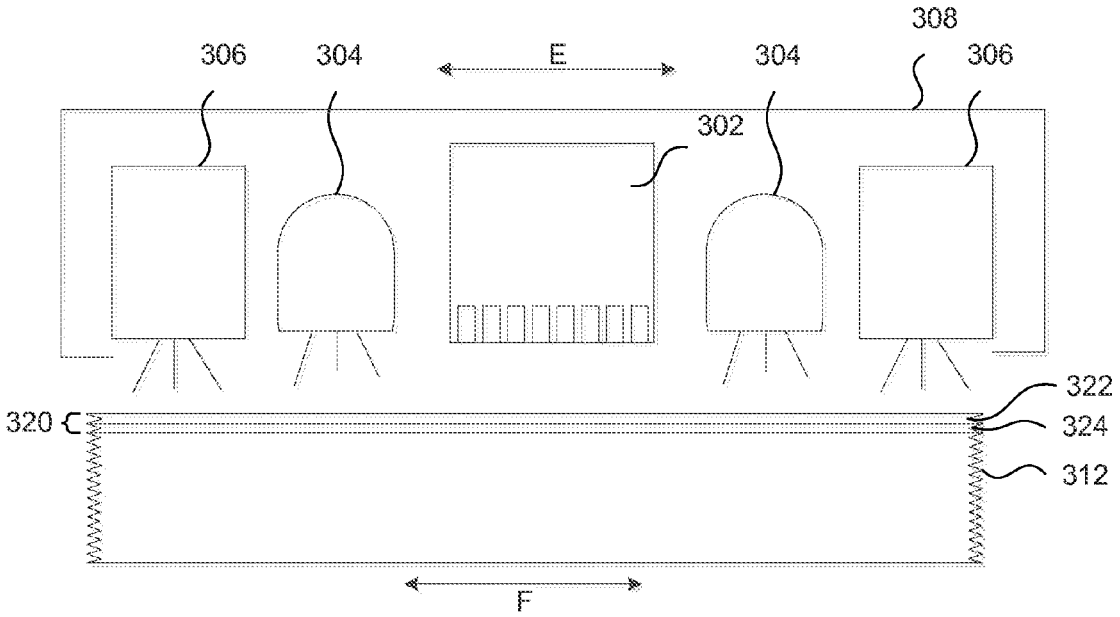
FIG. 3B is a side view of a printer head, a first light source, and a second light source according to an embodiment of the disclosure.

FIG. 3B is a side view of a printer head 302, a first light source 304, and a second light source 306 according to various embodiments of the disclosure. The printer head 302 may be, for example, printer head 102 of FIG. 1. Similarly, the first light source 304 may be, for example, the one or more light sources 104 of FIG. 1, and the second light sources 306 may be, for example, the one or more second light sources 106 of FIG. 1.

In various embodiments, the printer head 302 is an inkjet printer head configured to deposit a layer of ink 320 on a substrate 312. The ink may be, for example, a solid energy, e.g. UV, curable ink, a water-based energy curable ink, or a solvent-based energy curable ink. The first light source 304 comprises one or more light sources configured to emit UVC wavelengths of electromagnetic radiation. For example, the first light source 304 may be configured to emit UVC wavelengths of 254 nm. In various embodiments, a first light source 304 can be positioned adjacent to the printer head 302. In alternative embodiments, a plurality of first light sources 304 may be placed adjacent to the printer head 302, i.e. between the printer head 302 and a second light source 306, as shown in FIG. 3B. The first light source 304 may be, for example, a UVC fluorescent bulb, a UVC LED, a low pressure, e.g. mercury, bulb, or an excimer lamp and/or laser. In some embodiments, various combinations of UVC light sources may be used. Because of their shorter wavelengths, i.e. high energy, UVC wavelengths emitted from the first light source 304 are generally unable to penetrate deeply into the ink layer 320, but can prove effective at curing the upper level of ink 322.

The second light source 306 comprises one or more light sources configured to emit UVA, UVB, and/or UVV wavelengths of electromagnetic radiation. Because of their longer wavelengths and lower energy, UVA, UVB, and/or UVV wavelengths are capable of penetrating deeper into the energy curable ink layer 320. Thus, the UVA, UVB, and/or UVV wavelengths may be used to cure the lower level of ink 324. In various embodiments, the second light source 306 can be positioned adjacent to the first light source 304, but opposite the printer head 302. Similarly, a plurality of second light sources 306 may be placed adjacent to a plurality of first light sources 304, but opposite the printer head 302, as shown in FIG. 3B. The second light source 306 may be, for example, a UV LED configured to emit wavelengths of various lengths, e.g. 365 nm, 385 nm, 405 nm, 450 nm. The printer head 302, first light source 304, and second light source 306 can be positioned such that when the printer head 302 deposits a layer of ink 320 on a substrate 312, the layer of ink 320 is exposed to the first light source 304 prior to the second light source 306.

In various embodiments, the printer head 302, first light source 304, and second light source 306 may be coupled together, either directly or indirectly, within a carriage 308. The carriage 308 can be configured to move in relation to a substrate 312 that has been designated for printing. For example, the carriage 308 can move along path E, as shown in FIG. 3B, perpendicular to path E, or some combination of these directions. In some embodiments, the carriage 308 is fixedly attached to a base, and the substrate 312 is configured to move along path F, perpendicular to path F, or some combination of these directions.

Figure 4:
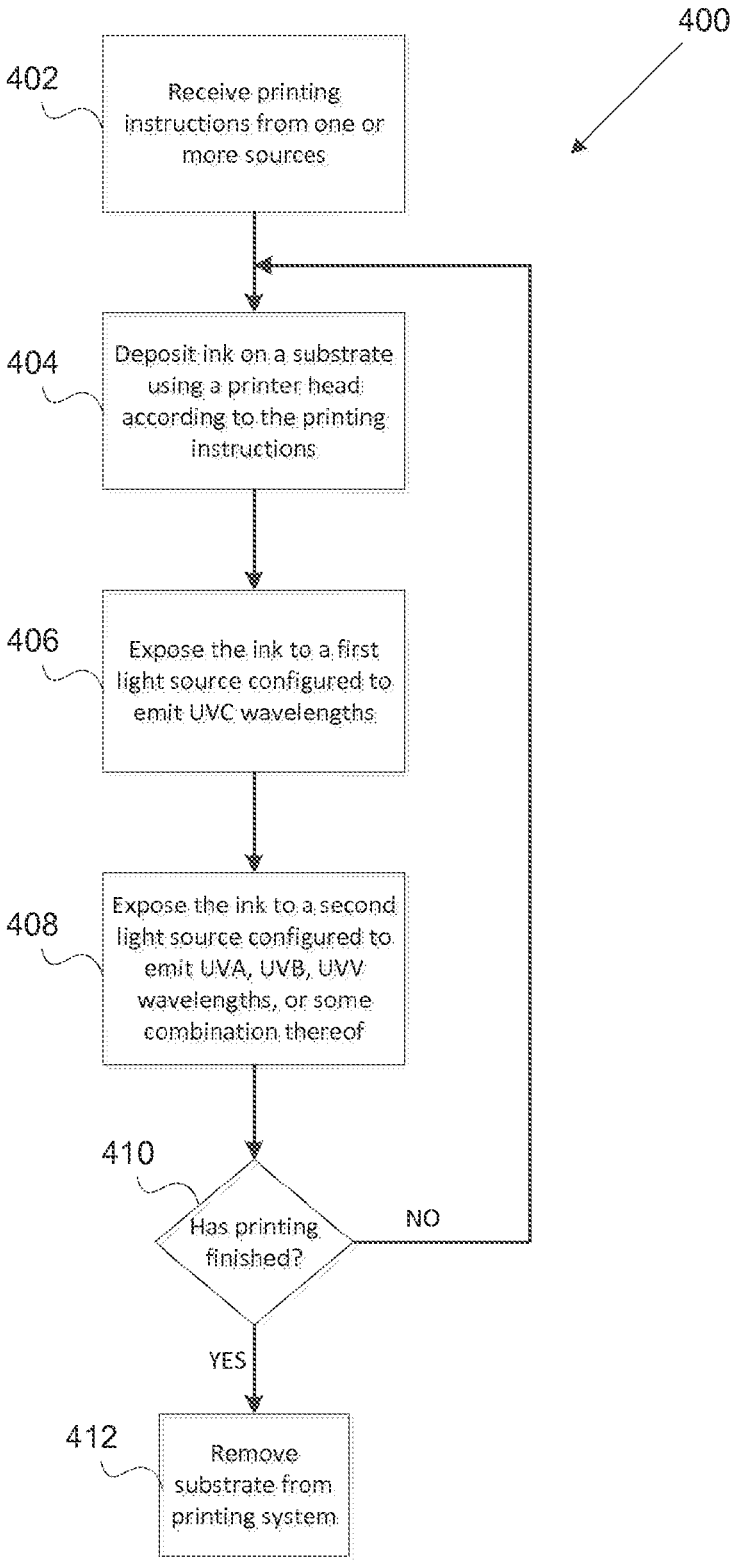
FIG. 4 is a flow chart illustrating an example method of printing using energy curable ink according to various embodiments of the disclosure.

Referring to FIG. 4, a flow chart illustrating an example method of printing using energy curable ink according to various embodiments of the disclosure. In various embodiments, a printing system, such as printing system 100 of FIG. 1, may receive printing instructions from one or more sources 402. The one or more sources may communicate printing instructions through a local physical connection, e.g. universal serial bus (USB) connection, or may remotely communicate printing instructions to the printing system, e.g. local Wi-Fi network, Bluetooth peer to peer connection, an Internet service provider (ISP) coupled to the local Wi-Fi network via a router, or any combination thereof. The printing system begins the process of printing and curing ink 400 deposited by a printer head, such as printer head 102 of FIG. 1. The printer head deposits ink on a substrate according to the printing instructions 404.

In various embodiments, the ink deposited on the substrate, such as substrate 112 of FIG. 1, can be exposed to a first light source configured to emit UVC wavelengths 406. The emitted UVC wavelength(s) may be, for example, 254 nm. In various embodiments, the first light source can be positioned adjacent to the printer head, such that the ink is exposed immediately following, or shortly thereafter, deposit on the substrate. In an alternative embodiment, a plurality of first light sources may be used, e.g. first light source 104 of FIG. 1. The plurality of first light sources can be placed adjacent to the printer head, as shown in FIG. 1.

Following exposure to the first light source, the energy curable ink can then be exposed to a second light source configured to emit UVA, UVB, and/or UVV wavelengths, or some combination thereof 408. The emitted wavelengths may be, for example, UVV wavelengths of 405 nm. The second light source can be positioned adjacent to the first light source, but opposite the printer head. In some embodiments, a plurality of second light sources may be placed adjacent to a plurality of first light sources, but opposite the printer head, as shown in FIG. 1. The first light source, second light source, and printer head can be configured such that ink deposited by the printer head on a substrate is exposed to the first light source prior to the second light source.

In some embodiments, the first light source and the second light source are incorporated into a single lamp housing or are combined to form a single mixed light source that is configured to emit wavelengths in different ranges, e.g., UVC wavelengths and UVB wavelengths. In a mixed light source embodiment the ink layer will be simultaneously exposed to the different ranges. These embodiments may result in reductions in cost, as well as a reduction in space, e.g. reduction in overall effective width of the carriage. Such embodiments may also result in higher overall print output speeds. In some embodiments, the first light source, i.e. UVC wavelengths, and the second light source, i.e. UVA/UVB/UVV wavelengths, can both be emitted from LEDs that are mixed. For example, the diodes may be arranged to preferentially and predominantly expose newly deposited ink to wavelengths in the UVC range before wavelengths in the UVA/UVB/UVV range.

Following exposure to the first light source and second light source, the printing system can determine whether printing has finished 410, i.e. whether printing instructions have been completed. If so, a user may remove the substrate from the printing system 412. If not, the printing system can continue the process of depositing ink on the substrate and exposing the ink to the first light source and the second light source.

Figures 5A, 5B:
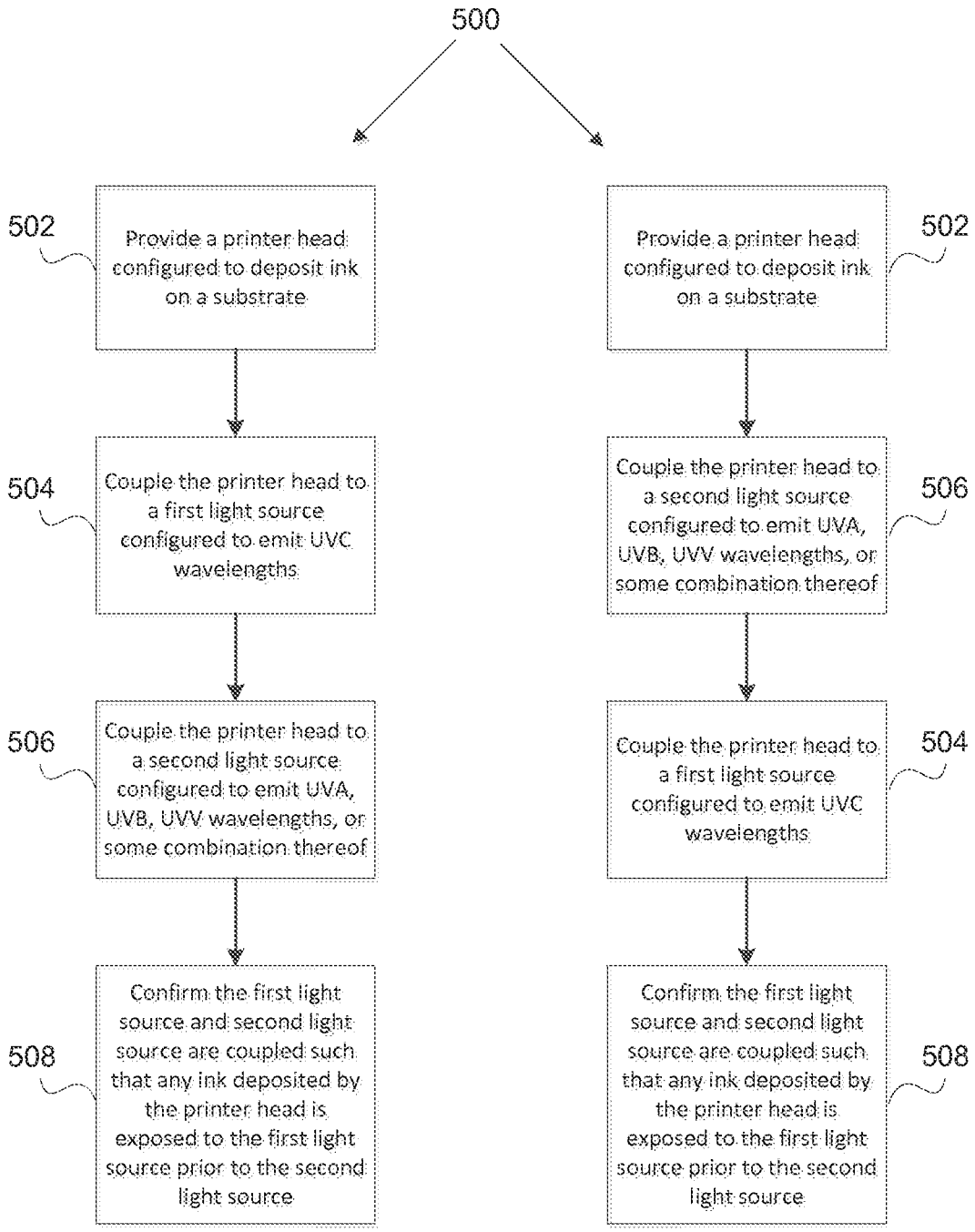
FIGS. 5A and 5B are flow charts illustrating various methods of manufacturing a printing system that cures according to various embodiments of the disclosure.

FIGS. 5A and 5B are flow charts illustrating various methods of manufacturing a printing system according to various embodiments of the disclosure. The method of manufacturing a printing system 500 includes providing a printer head configured to deposit ink 502, coupling the printer head to a first light source configured to emit UVC wavelengths 504, and coupling the printer head to a second light source configured to emit UVA, UVB, and/or UVV wavelengths, or some combination thereof 506. In various embodiments, the printer head, such as printer head 102 of FIG. 1, can be configured to deposit one or more solid-, water-, or organic solvent-based inks. The ink formulation may be modified depending on the a variety of factors, including substrate material, desired print speed, desired ink characteristics, e.g. color, thickness. As shown in FIGS. 5A and 5B, steps 504 and 506 can occur in any order; however, the first light source and second light source must be coupled to the printer head such that any ink deposited by the printer head on the substrate is predominantly exposed to the first light source prior to the second light source.

In various embodiments, the printer head provided in step 502 may be configured to deposit energy curable ink with a relative amount of photoinitiator that exceeds 5% by weight. The relative amount of photoinitiator may vary depending on the printing application desired, the ink formulation, and/or characteristics of the light sources in the printing system. In some embodiments, the first light source can be configured to emit UVC wavelengths of 254 nm. The UVC wavelengths may be emitted from, for example, a UVC fluorescent bulb, a UVC LED, a low pressure, e.g. mercury, bulb, or an excimer lamp and/or laser. In some embodiments, various combinations of UVC light sources may be used.

The method of manufacturing a printing system may further comprise providing a storage medium containing compressed air, and coupling the storage medium to a filter configured to remove oxygen from the compressed air. Depending on the amount of filtration, the filtered air comprises various concentrations of nitrogen and residual oxygen. The filtered air may be injected into a region between the surface of the ink and the first light source and/or second light source (see, for example, the region as illustrated in FIG. 3B). The filtered air reduces the oxygen concentration within the region. Although nitrogen concentrations of over 99% are attainable, the technology described herein does not require such levels. Instead, the storage medium and filter may be used in select embodiments, e.g. high speed printing, particular substrates, to improve effectiveness and/or efficiency. One skilled in the art will recognize that the oxygen concentration can be depleted in various ways, including flooding with an alternative inert gas, e.g. Argon, Helium, consuming the oxygen through a combustion or other oxidative reaction, etc.

Figure 6:
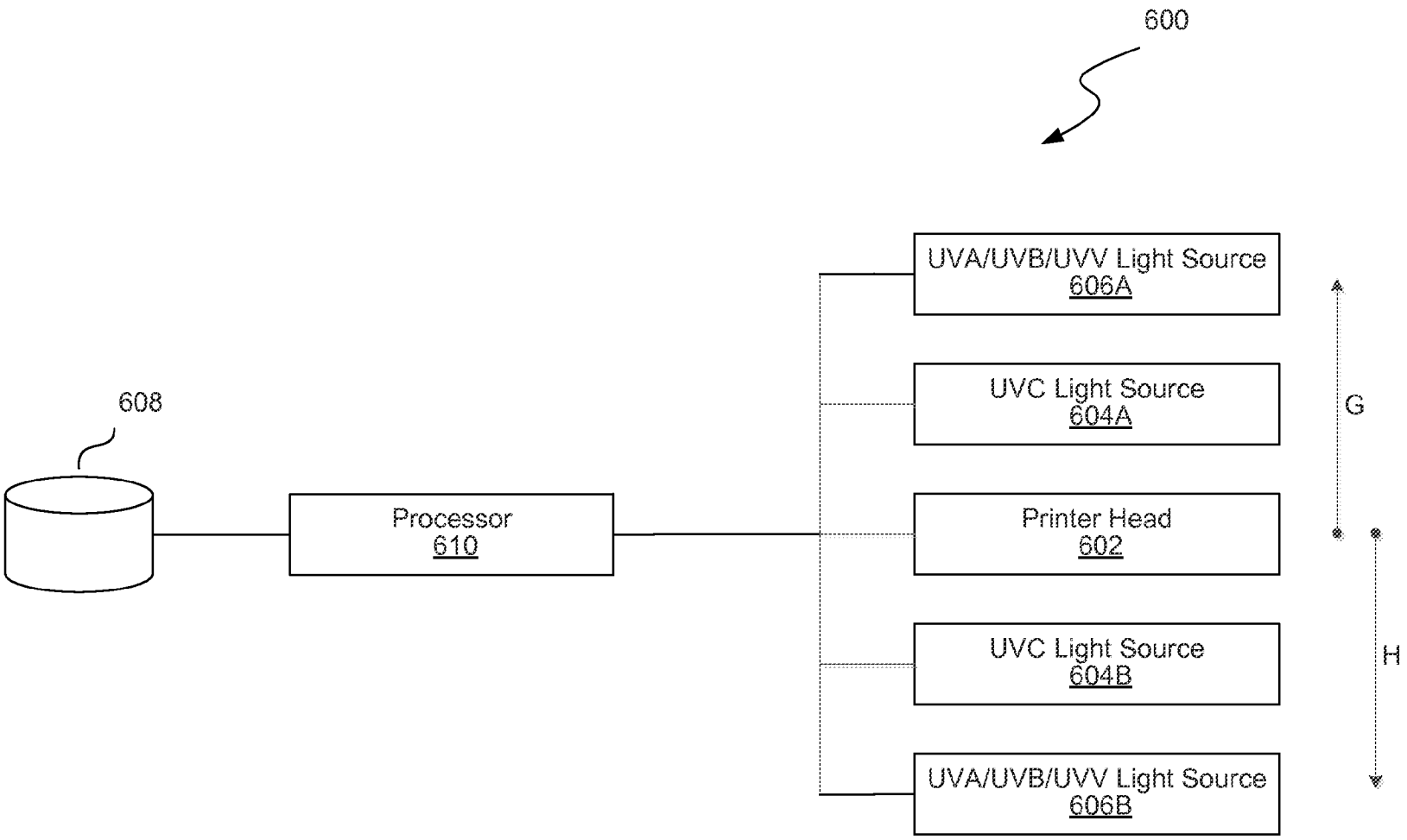
FIG. 6 is a computer diagram of a printing system in accordance with various embodiments.

Referring now to FIG. 6, a computer diagram of a printing system in accordance with various embodiments. FIG. 6 includes a memory 608, a processor 610, a printer head 602, one or more first light sources 604A, 604B, and one or more second light sources 606A, 606B. In various embodiments, the processor, based on one or more printing instructions stored in the memory 608, controls the printer head 602, one or more first light sources 604A, 604B, and one or more second light sources 606A, 606B. The printing instructions stored in the memory 608 may, for example, indicate that when the printing system 600 moves along path G, only first light source 604B and second light source 606B should emit wavelengths. Similarly, the printing instructions may, for example, indicate that when the printing system 600 moves along path H, only first light source 604A and second light source 606A should emit wavelengths. In some embodiments, the printing instructions may indicate that first light sources 604A, 604B and second light sources 606A, 606B should continue emitting wavelengths throughout the printing process.

In general, the printing instructions may contain information related to a variety of printing characteristics, including substrate media, ink, timing, etc. The printing characteristics may be used by the processor 610 to determine whether the printing system is a candidate for certain printing and/or curing processes. A curing process may require, for example, that first light source 604A emit wavelengths of a constant intensity for a specific period of time. As another example, the curing process may require that first light source 604A emit wavelengths of increasing or decreasing intensity over a specific period of time. One skilled in the art will appreciate that many curing processes are possible using various timeframes, intensities, rates, etc. The intensity may increase or decrease linearly or non-linearly, e.g., exponentially, logarithmically. In some embodiments, the intensity may be altered using a variable resistor or alternatively by applying a pulse-width-modulated (PWM) signal to the diodes in the case of an LED light source. The various curing processes described above may be used for first light sources 604A, 604B, second light sources 606A, 606B, or any combination thereof.

For example, if the printing system 600 is configured to deposit solid-based ink on a ceramic substrate, the processor 610 may indicate that first light sources 604A, 604B should emit low-intensity wavelengths for a short time period. In the same embodiment, the processor 610 may indicate that second light source 606A, 606B should emit high-intensity for a long time period in order to stimulate curing deeper within the ink layer. The printing instructions are generally related to the characteristics of the substrate, ink formulation, etc.

The instructions may be modified if, for example, the printing system 600 is instead configured to print using water-based diluted ink on a paper composite substrate. The curing intensities and/or curing times for first light sources 604A, 604B and second light sources 606A, 606B may be modified based on substrate characteristics, e.g. surface texture, surface condition, image quality, porosity, and/or ink characteristics, e.g. solid pigment concentration, ink formulation. One skilled in the art will appreciate that the printing system 600 may implement various printing and/or curing processes for the first light sources 604A, 604B, and the second light sources 606A, 606B. In some embodiments, first light source 604A and first light source 604B may be different UVC light sources, or identical UVC light sources implementing different curing processes. Similarly, second light source 606A and second light source 606B may be different UVA, UVB, and/or UVV light sources, or identical UVA, UVB, and/or UVV light sources implementing different curing processes.

Figure 7:
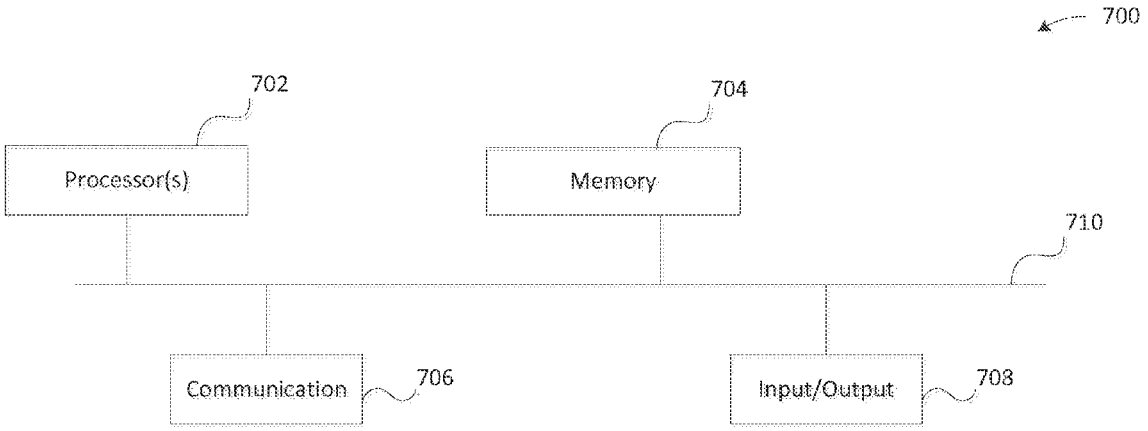
FIG. 7 is a block diagram illustrating an example of a processing system in which at least some operations described herein can be implemented, consistent with various embodiments.

FIG. 7 is a block diagram of a computer system that may be used to implement certain features of some of the embodiments of the invention. The computer system may be a server computer, a client computer, a personal computer (PC), a user device, a tablet PC, a laptop computer, a personal digital assistant (PDA), a cellular telephone, an Android, an iPhone, an iPad, a Blackberry, a processor, a telephone, a web appliance, a network router, switch or bridge, a console, a hand-held console, a (hand-held) gaming device, a music player, any portable, mobile, hand-held device, wearable device, or any machine capable of executing a set of instructions, sequential or otherwise, that specify actions to be taken by that machine.

The computing system 700 may include one or more central processing units ("processors") 702, memory 704, a communication device 706, and an input/output device 708, e.g. keyboard and pointing devices, touch devices, display devices, that are connected to an interconnect 710.

In FIG. 7, the interconnect 710 is illustrated as an abstraction that represents any one or more separate physical buses, point-to-point connections, or both connected by appropriate bridges, adapters, or controllers. The interconnect 710, therefore, may include, for example a system bus, a peripheral component interconnect (PCI) bus or PCI-Express bus, a HyperTransport or industry standard architecture (ISA) bus, a small computer system interface (SCSI) bus, a universal serial bus (USB), IIC (12C) bus, or an Institute of Electrical and Electronics Engineers (IEEE) standard 1394 bus, also referred to as Firewire.

The memory 704 is computer-readable storage media that may store instructions that implement at least portions of the various embodiments of the invention. In addition, the data structures and message structures may be stored or transmitted via a data transmission medium, e.g. a signal on a communications link. Various communications links may be used, e.g. the Internet, a local area network, a wide area network, or a point-to-point dial-up connection. Thus, computer readable media can include computer-readable storage media, e.g. non-transitory media, and computer-readable transmission media.

The instructions stored in memory 704 can be implemented as software and/or firmware to program one or more processors 702 to carry out the actions described above. In some embodiments of the invention, such software or firmware may be initially provided to the processor 702 by downloading it from a remote system through the communication device 706, e.g. Ethernet adapter, cable modem, Wi-Fi adapter, cellular transceiver, Bluetooth transceiver.

The various embodiments of the invention introduced herein can be implemented by, for example, programmable circuitry, e.g. one or more microprocessors, programmed with software and/or firmware, entirely in special-purpose hardwired, i.e. non-programmable, circuitry, or in a combination of such forms. Special-purpose hardwired circuitry may be in the form of, for example, one or more ASICs, PLDs, FPGAs, etc.

Although various embodiments employing a multi-pass (i.e., scan) printing configuration are described herein, one skilled in the art will recognize the same methods and systems for improved curing can also be applied to single-pass printing configurations.

Figure 8:
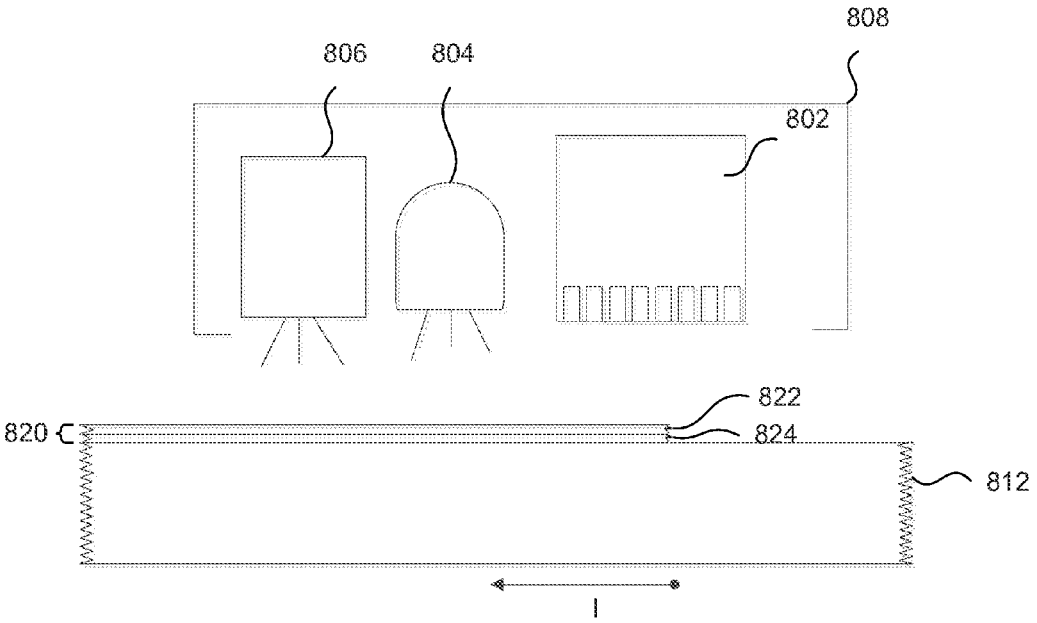
FIG. 8 is side view of a printer head, first light source, and second light source in a single-pass configuration according to some embodiments of the disclosure.

FIG. 8 is side view of a printer head 802, first light source 804, and second light source 806 in a single-pass configuration according to some embodiments of the disclosure. In various embodiments, the printer head 802 includes distinct ink/color drums (e.g., CMYK) configured to deposit a layer of ink 820 on a substrate 812 in one direct pass. In such embodiments, the substrate 812 passes by each ink/color drum a single time. The first light source 804 comprises one or more light sources configured to emit UVC wavelengths of electromagnetic radiation. In various embodiments, the first light source 804 is positioned adjacent to the printer head 802. In other embodiments, a plurality of first light sources 804 may be placed directly adjacent to the printer head 802, i.e. between the printer head 802 and a second light source 806, as shown in FIG. 8. Because of their shorter wavelengths, i.e. higher energy, UVC wavelengths emitted from the first light source 804 are generally unable to penetrate deeply into the ink layer 820, but can prove effective at curing the upper level of ink 822.

The second light source 806 comprises one or more light sources configured to emit UVA, UVB, and/or UVV wavelengths of electromagnetic radiation. Because of their longer wavelengths and lower energy, UVA, UVB, and/or UVV wavelengths are capable of penetrating deeper into the energy curable ink layer 820. Thus, the UVA, UVB, and/or UVV wavelengths may be used to cure the lower level of ink 824. The second light source 806 will preferably be positioned adjacent to the first light source 804 and opposite the printer head 802. Similarly, a plurality of second light sources 806 may be placed adjacent to a plurality of first light sources 804 and opposite the printer head 802, as shown in FIG. 8. The printer head 802, first light source 804, and second light source 806 can be positioned such that the layer of ink 820 deposited by the printer head 802 on a substrate 812 is predominantly or substantially exposed to the first light source 804 prior to the second light source 806. Although the ink may be described as being exposed to the first light source 804 "before" or "prior to" the second light source 806, one skilled in the art will realize that the layer of ink 820 is likely to be exposed to a combination of wavelengths emanating from both the first light source 804 and the second light source 806 at the same time.

In various embodiments, the printer head 802, first light source 804, and second light source 806 may be coupled together, either directly or indirectly, within a carriage 808. In a single-pass configuration, the carriage 808 will generally remain stationary while the substrate 812 moves, e.g. along path I as shown in FIG. 8. Various combinations of the printer head 802, first light source 804, and second light source 806 can remain stationary within the carriage 808. For example, the printer head 802 may be placed within the carriage 808 while the first light source 804 and second light source 806 remain outside the carriage 808.

Figure 9:
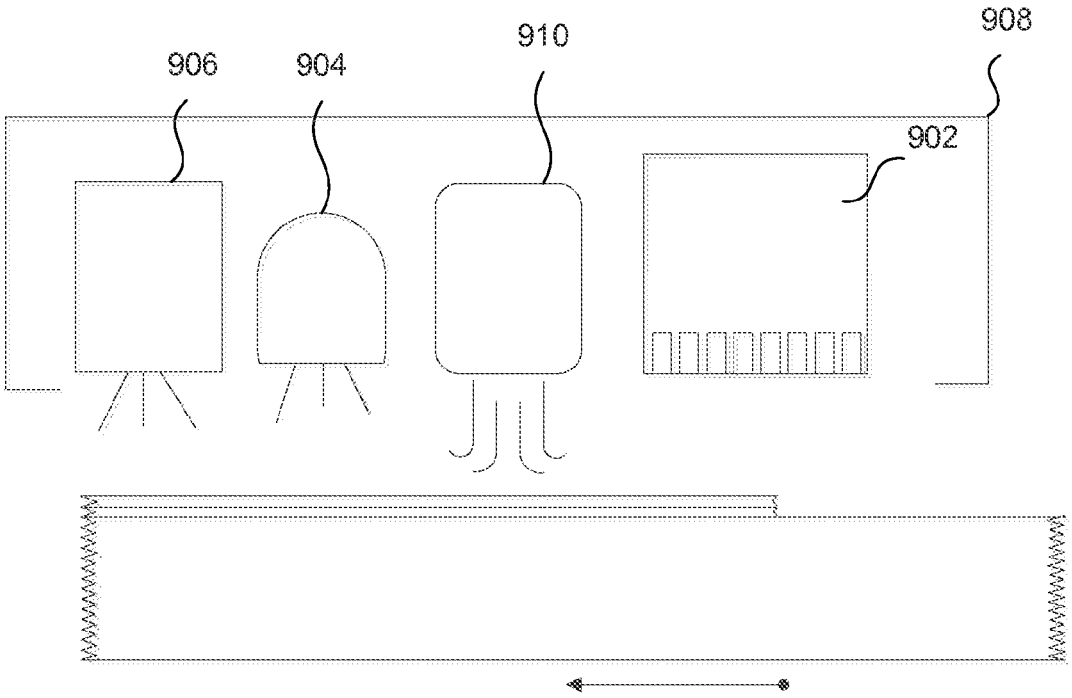
FIG. 9 is a side view of a printer head, first light source, second light source, and dryer in a single-pass configuration according to some embodiments of the disclosure.

FIG. 9 is a side view of a printer head 902, first light source 904, second light source 906, and dryer 910 in a single-pass configuration according to some embodiments of the disclosure. The printer head 902, first light source 904, and second light source can be similar or identical to printer head 802, first light source 804, and second light source 806 of FIG. 8. In some embodiments, a dryer 910 is configured to remove water or solvent from a water-based ink formulation or a solvent-based ink formulation prior to curing. As shown in FIG. 9, the dryer 910 can be positioned adjacent to the printer head 902, such that ink is dried, wholly or partially, prior to exposure to any UV wavelengths. As described above, some combination of the aforementioned components can be positioned within a carriage. For example, the printer head 902 and the dryer 910 may be positioned within the same stationary carriage 908. As another example, the printer head 902 may be positioned in a stationary carriage 908, while the dryer is positioned in a moveable carriage 908. In most embodiments, the dryer 910 is positioned to remove the water and/or solvent prior to exposure to the first light source 904. However, the dryer 910 may be placed between the first light source 904 and the second light source 906, adjacent to the second light source 906 and opposite the first light source 904, etc.

Embodiments that include a dryer 910 can employ various methods for curing the ink layer. For example, one method may include (1) drying the ink layer using the dryer 910; (2) exposing the ink layer to UVC wavelengths; and (3) exposing the ink layer to UVA/UVB/UVV wavelengths. As another example, a method may include: (1) drying the ink layer using the dryer 910; and (2) exposing the ink layer to UVC wavelengths. The second method may be preferable if the ink layer is thin and the UVC wavelengths can penetrate through the entirety or a substantial portion of the ink layer. Other dryer configurations are also possible, including having one or more dryers attached to either side of a carriage, one or more stationary dryers positioned downstream in the media feed direction, or some combination thereof.

Embodiments have been selected and described throughout this specification for illustration purposes. One skilled in the art will recognize that other embodiments are preferable and, in some instances, may be desirable. For example, in some embodiments a single mixed light source is configured to emit wavelengths in different ranges, e.g., UVC wavelengths and UVB wavelengths. In such embodiments the ink layer will be simultaneously exposed to the different ranges. A single mixed light source may be desirable when curing space is limited.

Similarly, many of the embodiments described herein can be modified for various printer configurations, e.g. flatbed, drum printer, lane printer. For example, a flatbed printer may include a stable bed and a traversing platform, stable printer heads and curing lamps and a traversing bed, etc.

Within the Detailed Description, a printing system and methods have been described that allow for effective and efficient surface and depth curing of an ink deposited on a substrate. Important printing properties, such as tack (a measure of the stickiness of a cured ink's surface), blocking (a measure of the ability of an ink's surface to adhere to another surface), and marring (a defect wherein the surface of the ink is weak and able to be smeared) are improved by various embodiments of the technology.

The language used in the specification has been principally selected for readability and instructional purposes, and it may not have been selected to delineate or circumscribe the inventive subject matter. It is therefore intended that the scope of the technology be limited not by the Detailed Description, but rather by any claims that issue on an application based hereon. Accordingly, the disclosure of the embodiments of the technology is intended to be illustrative, but not limiting, of the scope of the technology, which is set forth in the following claims.

The invention claimed is:

1. A printing system comprising:

a printer head configured to deposit ink on a substrate;

a first pair of light sources configured to emit electromagnetic radiation of subtype C (UVC) having a wavelength not exceeding 250 nanometers, the first pair of light sources being disposed opposite one another directly adjacent to opposing sides of the printer head;

a second pair of light sources configured to emit electromagnetic radiation of subtype A (UVA), subtype B (UVB), subtype V (UVV), or a combination thereof, the second pair of light sources being disposed opposite one another directly adjacent to the first pair of light sources, wherein the ink deposited by the printer head on the substrate is predominantly exposed to either of the first pair of light sources prior to exposure to either of the second pair of light sources.

2. The printing system of claim 1, wherein the ink is an ultraviolet energy curable ink.

3. The printing system of claim 1, wherein the ink is a water-based diluted ink or a solvent-based diluted ink, and the diluted ink has 30% or less residual solid by weight.

4. The printing system of claim 3, further comprising:

a dryer that wholly or partially removes the water from the water-based diluted ink or the solvent from the solvent-based diluted ink prior to exposure to either of the first pair of light sources.

5. The printing system of claim 1, wherein the ink is void of photoinitiator.

6. The printing system of claim 1, wherein the relative amount of photoinitiator in the ink exceeds 5% by weight.

7. The printing system of claim 1, wherein the ink comprises a first photoinitiator adapted to absorb a first range of wavelengths and a second photoinitiator adapted to absorb a second range of wavelengths.

8. The printing system of claim 1, wherein a first light source of the first pair of light sources disposed along a particular opposing side of the printer head and a second light source of the second pair of light sources disposed along the particular opposing side of the printer head form a single mixed light source, the mixed light source including a first plurality of light emitting diodes configured to emit electromagnetic radiation of subtype C (UVC) and a second plurality of light emitting diodes configured to emit electromagnetic radiation of subtype A (UVA), subtype B (UVB), subtype V (UVV), or the combination thereof, and wherein the first plurality of light emitting diodes and the second plurality of light emitting diodes are arranged such that newly deposited ink is predominantly exposed to the first plurality of light emitting diodes before the second plurality of light emitting diodes.

9. The printing system of claim 1, wherein each light source of the first pair of light sources emits electromagnetic radiation of subtype C (UVC) from a fluorescent bulb, a light emitting diode, a low pressure bulb, a medium pressure bulb, an excimer lamp, or an excimer laser.

10. The printing system of claim 1, wherein each light source of the first pair of light sources is configured to emit electromagnetic radiation of subtype C (UVC) having a power density of greater than or equal to 50 milliwatts per square centimeter.

11. The printing system of claim 1, wherein the printer head, the first pair of light sources, and the second pair of light sources are coupled together within a carriage.

12. The printing system of claim 11, wherein the ink is exposed to one of the first pair of light sources and one of the second pair of light sources when the carriage moves in relation to the substrate.

13. The printing system of claim 11, wherein the ink is exposed to one of the first pair of light sources and one of the second pair of light sources when the substrate moves in relation to the carriage.

14. The printing system of claim 1, wherein the printer head is substantially stationary and the substrate is transported relative to the printer head.

15. The printing system of claim 1, further comprising:

filter means configured to reduce oxygen concentration in a region between the surface of the ink and the first light source, such that the region is between 1% and 20% oxygen by volume.

16. A method of manufacturing a printing system comprising:

providing a printer head configured to deposit ink on a substrate; and coupling the printer head between a first pair of light sources, wherein the first pair of light sources is configured to emit electromagnetic radiation of subtype C (UVC) having a wavelength not exceeding 250 nanometers;

coupling a second pair of light sources directly adjacent to the first pair of light sources, wherein the second pair of light sources is configured to emit electromagnetic radiation of subtype A (UVA), subtype B (UVB), subtype V (UVV), or a combination thereof, and further wherein the first pair of light sources, the second pair of light sources, and the printer head are arranged such that ink deposited by the printer head on the substrate is exposed to either of the first pair of light sources prior to either of the second pair of light sources.

17. The method of claim 16, further comprising:

providing a storage medium containing compressed air; and coupling the storage medium to a filter configured to remove oxygen from the compressed air, thereby creating filtered air, wherein the filtered air is injected into a region between the surface of the ink and the first pair of light sources, thereby reducing oxygen concentration in the region.

18. The method of claim 17, wherein the oxygen concentration is between 1% and 20% by volume.

* * * * *